US007129813B2

(12) United States Patent
Kohno

(10) Patent No.: US 7,129,813 B2
(45) Date of Patent: Oct. 31, 2006

(54) WOUND-ROTOR TRANSFORMER AND POWER SOURCE DEVICE USING SAID WOUND-ROTOR TRANSFORMER

(76) Inventor: Kazuo Kohno, 332-30 Shitengi, Ohami Shirasato-machi, Sanbu-gun, Chiba-pref. (JP)

( * ) Notice: Subject to any disclaimer, the term of this patent is extended or adjusted under 35 U.S.C. 154(b) by 0 days.

(21) Appl. No.: 11/320,671

(22) Filed: Dec. 30, 2005

(65) Prior Publication Data

US 2006/0114092 A1 Jun. 1, 2006

Related U.S. Application Data

(62) Division of application No. 10/758,004, filed on Jan. 16, 2004, now Pat. No. 7,015,784.

(30) Foreign Application Priority Data

Jan. 21, 2003 (JP) ..... 2003-12537
Nov. 10, 2003 (JP) ..... 2003-379368
Dec. 5, 2003 (JP) ..... 2003-406767

(51) Int. Cl.
*H01F 27/28* (2006.01)

(52) U.S. Cl. ..... 336/170; 336/198

(58) Field of Classification Search ..... 336/65, 336/83, 170, 180–183, 198, 200
See application file for complete search history.

(56) References Cited

U.S. PATENT DOCUMENTS 4,218,645 A * 8/1980 Kirsch et al. ..... 322/47
6,150,914 A * 11/2000 Borho et al. ..... 336/180
2005/0219029 A1* 10/2005 Watanabe et al. ..... 336/208

FOREIGN PATENT DOCUMENTS

JP 10-241971 9/1988

* cited by examiner

*Primary Examiner*—Tuyen T Nguyen
(74) *Attorney, Agent, or Firm*—Wenderoth, Lind & Ponack, L.L.P.

(57) ABSTRACT

A small size wound rotor transformer having a simple structure, wherein the primary winding (32) is mounted on the central portion of a bobbin (insulator) (2), and the first and second secondary windings (39, 41) are mounted at both sides of the primary winding (32). The lead wire (39*a*) of one end of the first secondary winding is connected to the secondary high tension terminal (24) of the first terminal unit (16), and the lead wire (32*a*) of one end of the primary winding (32) and the lead wire (39*b*) of an end portion of the winding at the side in contact with the primary winding (32) of the first secondary winding (39) are respectively connected to the corresponding primary input terminal (22) and the ground terminal (20) of the first terminal unit (16). The lead wire (41*b*) of one end of the second secondary winding (41) is connected to the secondary high tension terminal (30) of the second terminal unit, and the lead wire (32*a*) of the other end of the primary winding (32) and the lead wire (41*a*) of the end portion of the winding at the side in contact with the primary winding (32) of the second secondary winding (41) are respectively connected to the corresponding primary input terminal (28) and the ground terminal (26) of the second terminal unit (18). The core (42) is mounted on the bobbin (insulator) (2).

4 Claims, 15 Drawing Sheets

WOUND-ROTOR TRANSFORMER AND POWER SOURCE DEVICE USING SAID WOUND-ROTOR TRANSFORMER

This is a divisional application of Ser. No. 10/758,004, filed Jan. 16, 2004, now U.S. Pat. No. 7,015,784.

BACKGROUND OF THE INVENTION

The present invention relates to output transformer for wound rotor high tension of plural output type to be used in inverters for driving loads such as cold cathode fluorescent lamps and the like and a power source device using said wound-rotor output transformers for high tension.

Heretofore, a transformer (for example, refer to Japanese official gazette, Japanese Patent Kokai 2002-07575) is known wherein a plurality of mid leg portion and separate wall portion and external wall portion are formed at least one part of a set of cores forming a closed magnetic circuit, and separate secondary windings are mounted concentrically on each of the mid leg portion, and a primary winding is mounted on the inside of the outer peripheral wall portion to enclose the secondary windings thereby exciting the plural secondary windings simultaneously by one primary winding.

Furthermore, as illustrated in FIG. 16, in the case of driving cold cathode fluorescent lamp 46 with the output of the wound-rotor transformer, heretofore, an electrode of the fluorescent lamp 46 is connected to a high tension terminal of the winding of the secondary side of a wound-rotor transformer T by means of a capacitor, and the capacitor and the other electrode of the fluorescent lamp 46 is connected to the earth by means of a resistor. Furthermore, in the case of driving four pieces of the fluorescent lamps, as shown in FIG. 17, wound-rotor transformers T1, T2, T3 and T4 are prepared, and two pieces of the fluorescent lamps 46, 46 are connected in series, and among each pair of the fluorescent lamps, the fluorescent lamps 46, 46 of one part are connected to the secondary side high tension terminals of the corresponding wound-rotor transformers T1, T3 by means of a ballast capacitor, and the other part of the fluorescent lamps 44, 44 are connected to the secondary side high tension terminals of the corresponding wound rotor transformers T2, T3 by means of a ballast capacitor, and the other terminals at the secondary side of each wound rotor transformers T1, T2, T3, T4 is connected to the earth.

Furthermore, in a ballastless discharge lamp lighting circuit using multi-lamp leakage transformers, a DC/AC inverter circuit (for example, refer to official gazette of Japanese Patent Kokai 20 02 075756) is known in which both terminals of one part of the secondary winding are connected to both terminals of the discharge lamp by means of an earth (ground) wire, and the other secondary windings are connected to both terminals of another discharge lamp by means of the ground wire, and as a result, two discharge lamps are simultaneously driven by one input.

Heretofore, in the wound-rotor output transformers for high tension, and in the case of constructing a plurality of output units at the secondary side, there have been problems in that the structure of the core and the arrangement of windings becomes complicated and requires a large size structure.

An object of the present invention is to solve the foregoing problems.

Furthermore, in a system of driving fluorescent lamps by connecting one electrode of the fluorescent lamp (discharge lamp) to a high tension terminal at the secondary side of the wound-rotor transformer and connecting the other electrode to the ground wire, one terminal side of the fluorecent lamp becomes high tension, and the other terminal side becomes low tension, and thereby the transformer connected side turns to bright while the ground wire connected side turns to dark, and irregularity of luminance occurs which are points of problems. In a system of driving two pieces of fluorescent lamps with two pieces of wound-rotor transformers, high tension occurs at both terminals of two pieces of the fluorescent lamps, and thus, occurrence of generation of irregularity of brightness may be eliminated but a wound rotor transformer is required for each of the fluorescent-lamps which does not meet with miniaturization of the wound-rotor transformers which are points of problems.

The present invention aims to solve the foregoing problems.

SUMMARY OF THE INVENTION

The present invention is constructed in such a way that a primary winding is mounted in a central portion of an insulator such as a bobbin and the like, and first and second secondary windings are mounted at both sides of this primary winding. A lead wire of a terminal of the first secondary winding is connected to a secondary high tension terminal of a first terminal unit, and the lead wire of one terminal of the primary winding and the lead wire of one terminal of a winding at the side in contact with the primary winding of the first secondary winding are respectively connected to a primary input terminal and a ground terminal corresponding to the first terminal unit. The lead wire of one end of the second secondary winding is connected to the secondary high tension terminal of the second terminal unit, and the lead wire of another terminal of the primary winding and the lead wire of one end of the winding at the side in contact with the primary winding of the second secondary winding are connected to the primary input terminal corresponding to the second terminal unit and the ground terminal. A core is mounted on a bobbin (insulator) to construct a wound rotor transformer having a plurality of outputs.

Furthermore, the present invention provides a power source device by providing a resonance circuit at a primary side by connecting a resonance capacitor to the primary winding of the wound rotor transformer, and connecting a self-commutating circuit that self commutates with resonance frequency at the primary side on the basis of a feedback signal of the resonance voltage at the primary side to the primary winding. It is possible to generate high tension at the primary side of the output circuit at the primary side of the output transformer and as a result, high tension can be obtained without increasing a number of windings at the secondary side whereby a small size circuit of the output transformer can be constructed.

Whereas the present invention is constructed in such a way that among two pieces of fluorescent lamps of the first and second fluorescent lamps, one electrode of the first fluorescent lamp is connected to a secondary high tension terminal of the first secondary winding, and the second fluorescent lamp is connected in series to the secondary high tension terminal of the second secondary winding.

DETAILED DESCRIPTION OF THE INVENTION

Figure 1:
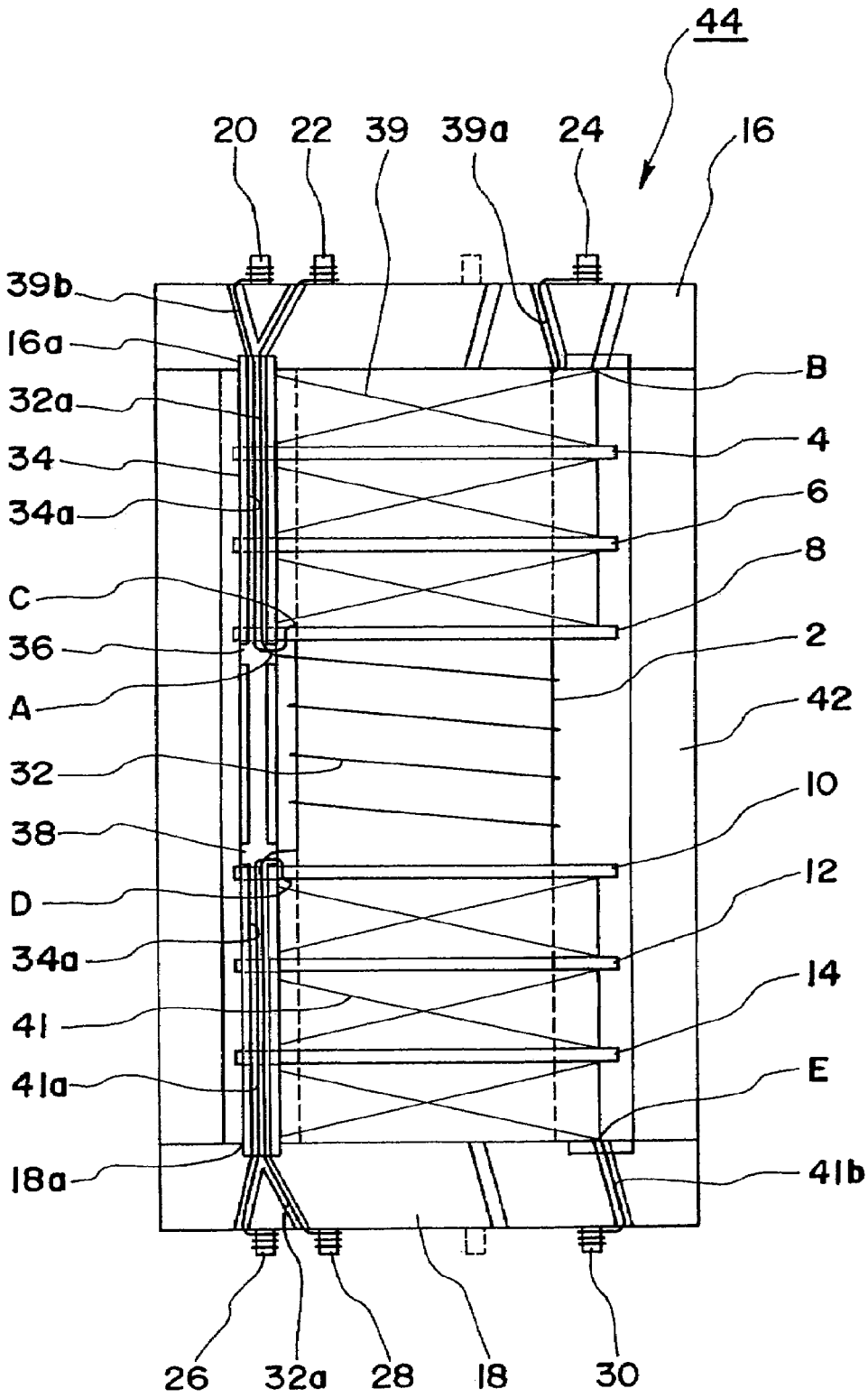
FIG. 1 is a descriptive plan view of a wound rotor transformer of the present invention.
Figure 2:
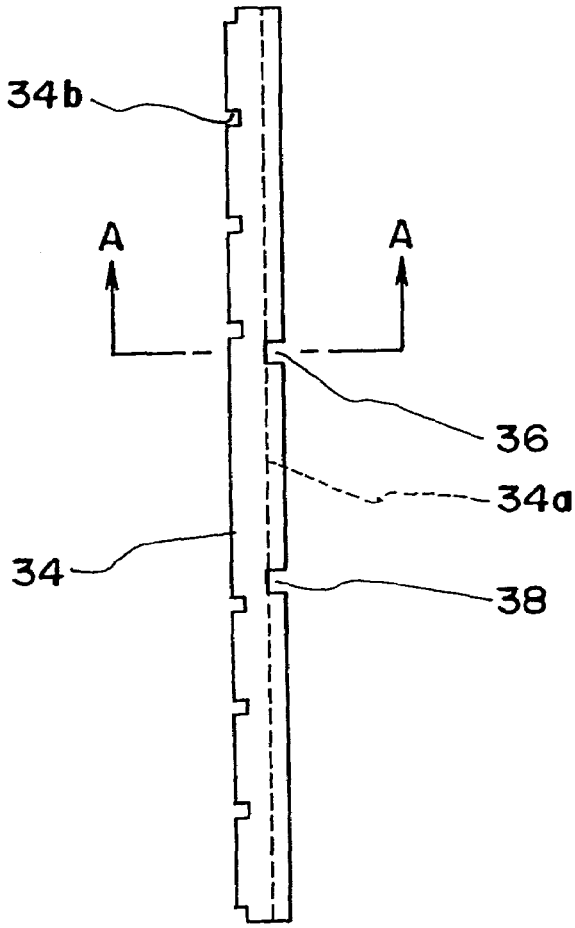
FIG. 2 is a plan view of a shielding member.
Figure 3:
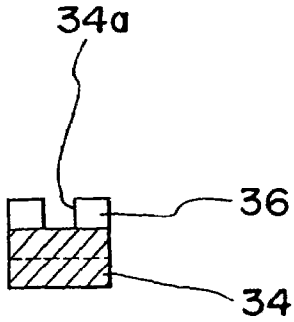
FIG. 3 is a cross sectional view taken along line A—A of FIG. 2.
Figure 4:
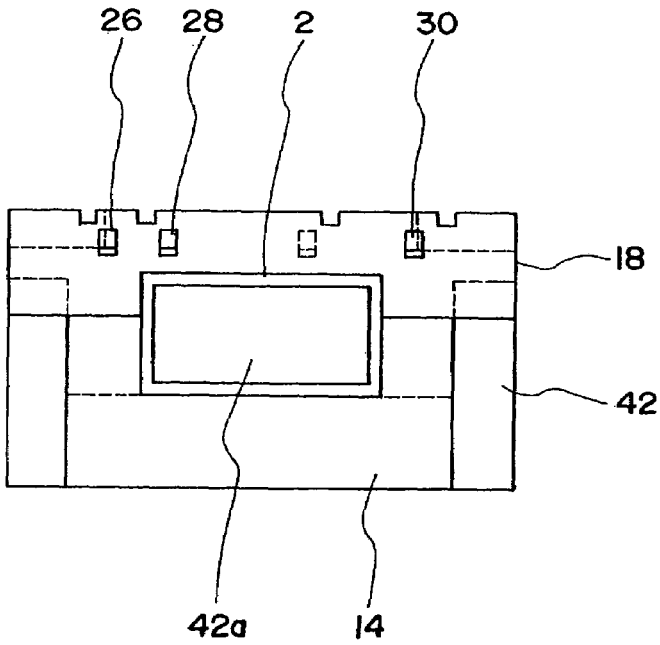
FIG. 4 is a side view of the wound rotor transformer of the present invention.
Figure 5:
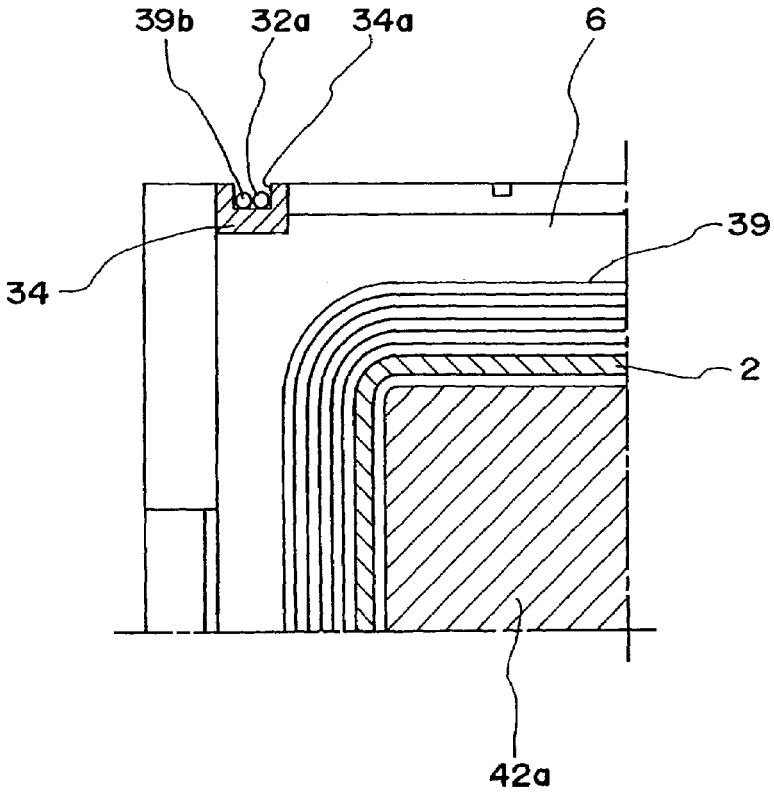
FIG. 5 is a cross sectional view of an important part of the wound rotor transformer.

The present invention will be described in detail in connection with preferred embodiments by referring to the drawings.

In FIG. 1, numeral 2 denotes a bobbin (insulator) of a wound rotor transformer 44, and a plurality of partitions 4, 6, 8, 10 12, 14 of square plate type for insulation and pressure resistance are provided with a predetermined interval at its angular cylindrical part, and terminal units 16, 18 extending in right angle directions relative to an axial direction of the bobbin (insulator) are fixed at both ends in the axial direction of the bobbin (insulator) 2, and terminals 20, 22, 24,26, 28, 30 are fixed to the bobbin.

A secondary high tension terminal 24 is disposed on the terminal unit 16 in its one side, the terminal unit 16 is positioned at one end side of the bobbin (insulator) 2. A primary input terminal 22 and a secondary ground terminal 20 are disposed at the other side. The primary input terminal 22 and the ground terminal 20 are disposed at the other side of the terminal unit 16 so that those terminals are not under influence of high tension of the secondary high tension terminal 24 by keeping them apart as much as possible. On the terminal unit 18 at the other side of the bobbin (insulator) 2, a secondary high tension terminal 30 is disposed at the one side, and the primary input terminal 28 and the secondary ground terminal 26 are disposed at the other side which are kept away from them as much as possible. A shelter 34 made of elongate insulation material is mounted in guide mounting grooves 16*a*, 18*a* formed at the mounting side of the terminals 20, 22 and 26, 28 of the terminal units 16, 18 and a concave portion 34*b* of the shelter 34 fits external edges of the corresponding partitions 4, 6, 8, 10, 12, 14. On the insulator 34, a lead wire guide portion 34*a* formed by a groove open to the opposite side from the side facing the bobbin (insulator) 2 along its longitudinal direction.

In the concave portion surrounded by the partitions 8, 10 at the center of the bobbin (insulator) 2, with one end side A as the start of winding, the primary winding 32 is, for example, wound in a clockwise direction. The lead wire 32*a* of the winding start end of the primary winding 32 is disposed inside of a lead wire guide portion 4*a* of the shelter 34 through the hole 36 formed on the shelter 34 and is led to one end side of the bobbin (insulator) 2 through the lead wire guide portion 34*a*, and is connected to a primary side input terminal 22 by means of a guide groove formed on the terminal unit 16. The lead wire 32*a* of the last end side D of the primary winding 32 is disposed inside of the lead wire guide portion 34*a* of the shelter 34, and is led to the other other end side of the bobbin (insulator) 2 through the hole 38 formed on the shelter 34, and is led to the other end side of the bobbin (insulator) 2 through the lead wire guide portion 34*a* and is connected to the primary side input terminal 28 by means of the guide groove formed on the terminal unit 18. At one side of the primary winding 32 on the bobbin (insulator) 2, one end side B of the bobbin (insulator) 2 becomes a winding start, and a first secondary winding 39 is a clockwise winding, and is sequentially wound around each concave portion between the terminal unit 16, and partition 4, partitions 4 and 6, and partitions 6 and 8.

The reason for dividing the mid portion of the secondary winding 39 with a plurality of partitions 4, 6 and 8 is to take a consideration of the insulation pressure resistance of the secondary winding 39. A lead wire 39*a* at the winding start end side B of the first secondary winding 39 is led to the secondary high tension terminal 24 through the groove formed by the terminal unit 16 and is connected thereto. A lead wire 39*b* at the winding end side C of the first secondary winding 39 is disposed in the lead wire guide portion 34*a* of the shelter 34 by means of the hole 36, and is led to one end side of the bobbin (insulator) 2 through the lead wire guide portion 34*a* together with the lead wire 32*a*, and is connected to the ground terminal 20 at the secondary side by means of the guide groove formed on the terminal unit 16. At the other side of the primary winding at the center of the bobbin (insulator) 2, the side D in contact with the partition 10 is the winding start, and the second secondary winding 41 is a clockwise winding, and is sequentially wound around each concave portion between the partitions 10 and 12, partitions 12 and 14, and partitions 14 and the terminal unit 18.

The first and second secondary windings 39 and 41 disposed symmetrically at right and left of the primary winding 32 are of an identical construction. A lead wire 41*b* at the last end side E of the second secondary winding is led to the secondary high tension terminal 30 through the groove formed by the terminal unit 18, and is connected thereto. A lead wire 41*a* at the winding start end side D of the second secondary winding 41 is disposed inside of the lead wire guide portion 34*a* of the shelter 34 by means of the hole 38, and is led to the other end side of the bobbin (insulator) 2 through the lead wire guide portion 34*a* along with the lead wire 32*a* of the primary winding 32, and is connected to the secondary side ground terminal 26 by means of the guide groove formed on the terminal unit 18. As will be obvious from the winding structure disclosed in the foregoing, both terminals of the primary side winding 32 between the partitions 8 and 10 come to contact the ground side of low voltage of the secondary windings 39 and 41 and the difference with the voltage of the adjacent primary winding 35 and the voltage of the secondary windings 39 and 41 becomes smaller.

For this reason, the insulation pressure resistance structure between the primary winding 32 and the secondary windings 39 and 41 can be made of a simpler structure. Since the potential difference is small at the ground side of the primary winding 32 and the secondary windings 39 and 41, there will be no problem about the insulation pressure resistance even if both the windings are disposed in parallel through the common lead wire guide portion 34*a*. For reference, even if a plurality of lead wire guide portions are provided on the shelter 34 and a piece of the lead wire may be separately disposed on the lead wire guide portion. Numeral 42 denotes a core, and two pieces of E shape cores are jointed to form the core, and an external portion is disposed at the outside of the bobbin (insulator) 2, and an inside portion 42*a* of the core 42 is disposed in a cylindrical portion of the bobbin (insulator) 2. The foregoing wound rotor transformer 44 constitutes one input/two outputs and is capable of driving two pieces of cold cathode fluorescent lamps with the use of this transformer in a condition where there is no irregularity in the degree of brightness. In this case, the two pieces of lamps, who's both terminals are connected to the high tension side of the secondary windings 39 and 41, there is the occurrence of causing the difference in brightness at both ends of the lamps.

Figure 6:
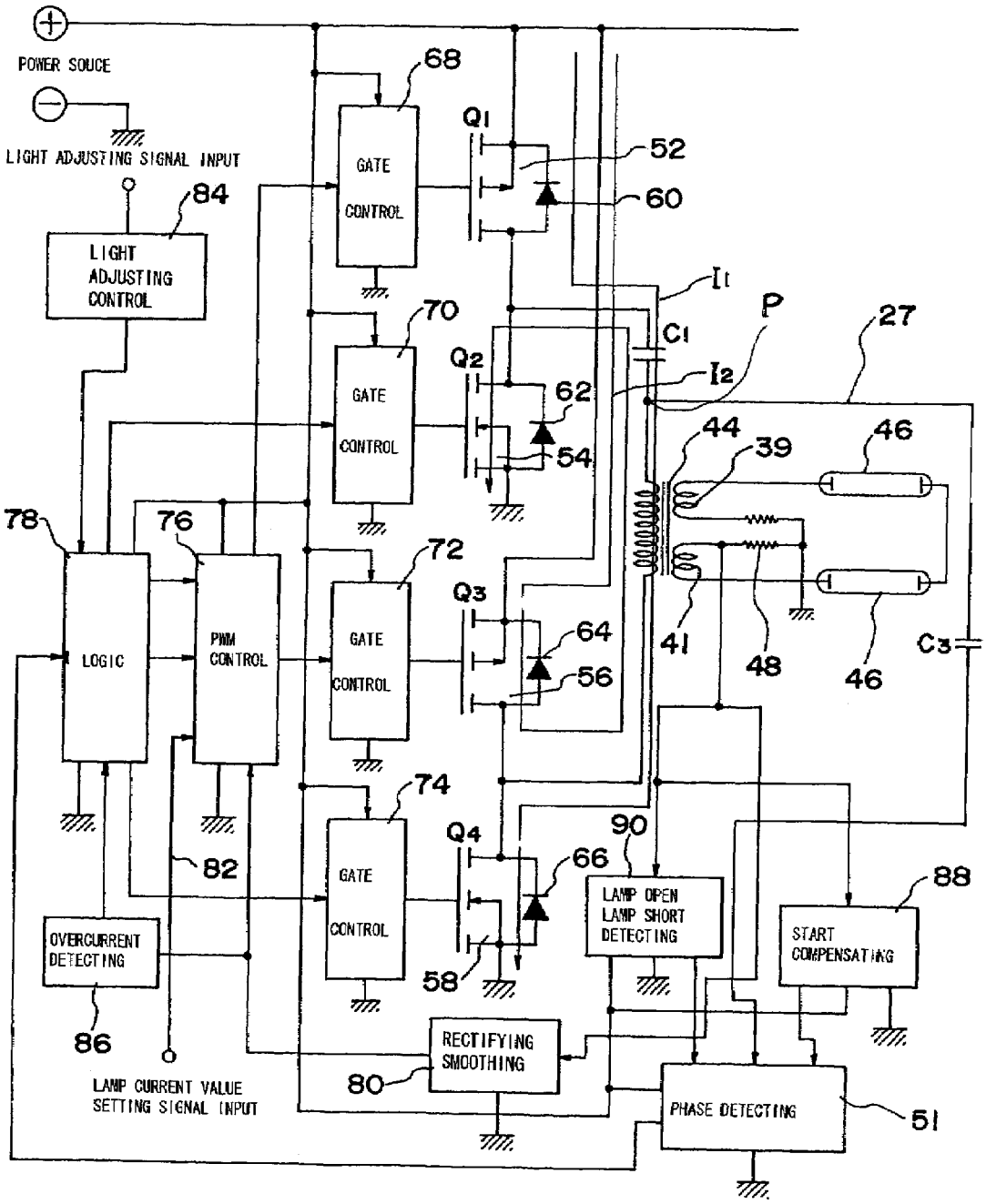
FIG. 6 is a block circuit diagram showing an example of an application of the present invention.

The above noted one input/two output wound rotor transformer 44 constitutes a series or parallel resonance circuit at the primary side of this transformer, and is desirably driven with a self commutating circuit that generates commutation voltage at the primary side of the transformer. In this case, when the higher tension than the power source voltage is generated at the primary side of the transformer, a quantity of windings at the secondary side can be minimized, and as a result, two outputs can be materialized with the size equal to the wound rotor transformer of the conventional one input/one output. Moreover, the one input/two output wound rotor transformer concentrates the heat generation with the primary coil and the core in the central portion of the transformer but the heat generation produced in the center portion of the transformer so that a balance of the joint with the secondary winding is kept in a favorable condition, and the transformer operates with efficiency. Like the conventional wound rotor transformer of the one input/one output type, when the heat generation concentrates at one side of the transformer, an imbalance occurs in the joint of the primary winding and the secondary winding which blocks an efficient operation. An embodiment of driving the wound rotor transformer 44 with the self commutating circuit that generates commutation voltage at the primary side of the wound-rotor transformer will be described in the following by referring to FIG. 6. In FIG. 6, numerals 52, 54, 56, 58 denote switching elements consisting of FET, and commutation diodes 60, 62, 64, 66 are connected between source and drain of each switching element. At respective gates of the switching elements 52, 54, 56, 58, gate control circuits 68, 70, 72, 74 are connected, and among them, the gate control circuit 68 and 72 are connected to a PWM control circuit 76, and the gate control circuits 70 and 74 are connected to a logic circuit 78. The PWM control circuit 76 receives signals from a commutation smoothing circuit 80 that detects an electric current flowing in the lamps, and controls a conductance angle of the switching elements 52 and 56 so that a level of this signal becomes a set value to be given by the line 82. Numeral 44 denotes a wound rotor transformer of one input/two output type fixed to a substrate (drawing is omitted), and two pieces of cold cathode fluorescent lamps 46 and 46 are connected in series, and each terminal of the fluorescent lamps 46, 46 is connected respectively to high tension terminal side of the secondary coils 39, 41 of the wound rotor transformer 44. Each terminal of the secondary side windings 39, 41 is grounded respectively by means of resistors.

One resistor 48 constitutes an electric current detecting circuit, and is connected to a lamp open, lamp short detecting circuit 90 and a start compensating circuit 88. A phase detecting circuit 51 is connected to a mid point P of an EC series resonance circuit by means of the lead wire 27. A logic circuit 78 is constructed in such a way that a signal produced for turning on and off of the switching elements on the basis of a resonance phase signal at the primary side from a phase detecting circuit 51 connected to the lead wire 27, and transmits an on/off control signal to the gate control circuits 68 and 72 by means of a PWM control circuit 76, and transmits an on/off control signal to the gate control circuits 70 and 74. The phase detecting circuit 51 supplies a compensation phase signal delayed by 90 degrees from a phase voltage signal of the mid point P of the LC series resonance circuit to a logic circuit 78. This signal becomes an identical phase with electric current flowing in the LC series resonance circuit at the primary side. The electric current flowing in the series resonance circuit at primary side is such that even if a charge voltage of the capacitor C1 reaches DC power source voltage, the voltage of the primary side terminal of the transformer 44 gets lowered further beyond OV after lapse of phase time of 90 degrees electrically, and furthermore becomes a maximum value of minus upon lapse of the phase time of 90 degrees.

At this time, the signal delayed by 90 degrees from this voltage becomes OV so that the switching control signal is turned on and off by this timing. The logic circuit 78 outputs the switching control signals alternately in such a manner. The logic circuit 78 creates a light adjusting control signal on the basis of an output signal of a light adjusting control circuit 84 to which a light adjusting signal is inputted, and with this light adjusting control signal, burst control of the on/off of the switching elements and control of switch on pulse width of the PWM control circuit 76 are achieved, and as a result, brightness of the lamps 46 and 46 is kept constant, and setting to an optional value from brightness zero to 100% can be performed according to the light adjusting signal. Moreover, the logic circuit 78 is connected to an overcurrent detecting circuit 86, and when overcurrent flows to the lamp 20, the logic circuit detects it and transmits the signal blocking the overcurrent to the PWM control circuit 76 to prevent the occurrence of such trouble.

The start compensating circuit 88 is connected to an energizing circuit of the lamp 48 and an electric current signal of the lamp 46 is inputted to the circuit. The start compensating circuit 88 transmits the start compensating signal to the phase detecting circuit 51 to cause the self commutating circuit to positively start when the power source is on and off. The phase detecting circuit 51 outputs the start signal for self commutation to the logic circuit 78 after receiving the start compensating signal. The start compensating circuit 88 is constructed in such a way that even if the electric current flows to the primary side of the transformer after sending the phase corrected signal from the phase detecting circuit 51 to the logic circuit 78 in a direction determined by the logic, the discharge of the lamp 46 does not always start. The start compensating circuit 88 is provided for compensation of start as described above. In this case, in order to light up the lamp 46 positively, the start compensating circuit 88 judges whether or not the lamp 46 is lighted upon detection of the electric current flowing in the light lamp 46, and when the lighting is not recognized, the start compensating signal is transmitted to the phase detecting circuit 51 until the lighting occurs.

The phase detecting circuit 51 outputs the start signal until lamp 46 lights up by receiving the start compensating signal to the phase detecting circuit 51. The light adjusting control circuit 84 generates a bust light signal of a predetermined period after comparison of the voltage of the light adjusting signal input with the output voltage of the triangular wave oscillating circuit built therein. The entire logic signal is made subject to ON Off according to a duty cycle of this signal and as a result, the brightness is capable of adjusting freely from the turn off the light to full lights on, but the lamp 46 requires the start confirmation and the positive start for its period because the light adjusting is subject to ON OFF in the period of the light adjusting signal. For this reason, the start compensating circuit 88, as described in the foregoing, transmits the start compensating signal to the phase detecting circuit 51 in the beginning in order to effect the positive start of lighting. The operation of the start compensation is described by referring to FIG. 9, the switching elements 52 and 58 are turned ON with a predetermined pulse width so that the electric current flows a direction of II when the power source is energized for the first time or the lamp is not lighted on.

By the foregoing operation, the electric current flows to the capacitor (C 1) and the primary winding of the transformer 44, and the signal is transmitted to the phase detecting circuit 51 by means of the lead wire 27, and the electric current flows alternately 12, II, 12, II, and the self commutating circuit starts the oscillation with the detected resonance frequency. The start compensating circuit 88 produces reset (start time) of the logic circuit 78. If the lamp 46 does not light up, the reset is tried again, and firstly, the initial start signal is transmitted to the logic circuit 78 through the phase detecting circuit 90. A lamp open, short detecting circuit 90 is connected to the secondary side of the wound rotor transformer 10, and detects the voltage and the electric current at the secondary side. In the lamp open condition where the lamp 46 is not lighted on or the lamp 46 is not mounted or the lamp short where the wiring of the lamp is short, the signal is transmitted to the logic circuit 78 through the phase detecting circuit 51, and shuts out the control circuit consisting of the logic circuit 78, PWM control circuit 76 and gate control circuits 68, 70, 72, 74. The overcurrent detecting circuit 86 transmits the signal to the logic circuit 78 in the condition where the PWM control circuit 76 is in appropriate or the wiring of the lamp 20 is short and the like to shut off the control circuit.

In the foregoing construction, when the power source switch is turned on, the on signal forms the PWM control circuit 76 and the logic circuit 78 is instantly supplied to any one of the gate control circuits 68, 74 or 72, 70, the electric current flows to the primary side winding of the wound rotor transformer 10 in a direction of II through the switching elements 52, 58 or in a direction of 12 through the switching elements 56, 54. By this operation, the self commutating circuit starts, and the resonance voltage is generated by the wound rotor transformer 44. The frequency of the resonance voltage at the primary side of the wound rotor transformer 44 is supplied to the phase detecting circuit 51 by the lead wire 27. The logic circuit 78 and PWM control circuit 76 drive the gate control circuits 68, 70, 72, 74 on the basis of the phase signal from the phase detecting circuit 51 to perform the on off control of the switching elements 52, 54, 56 and 58.

Figure 7:
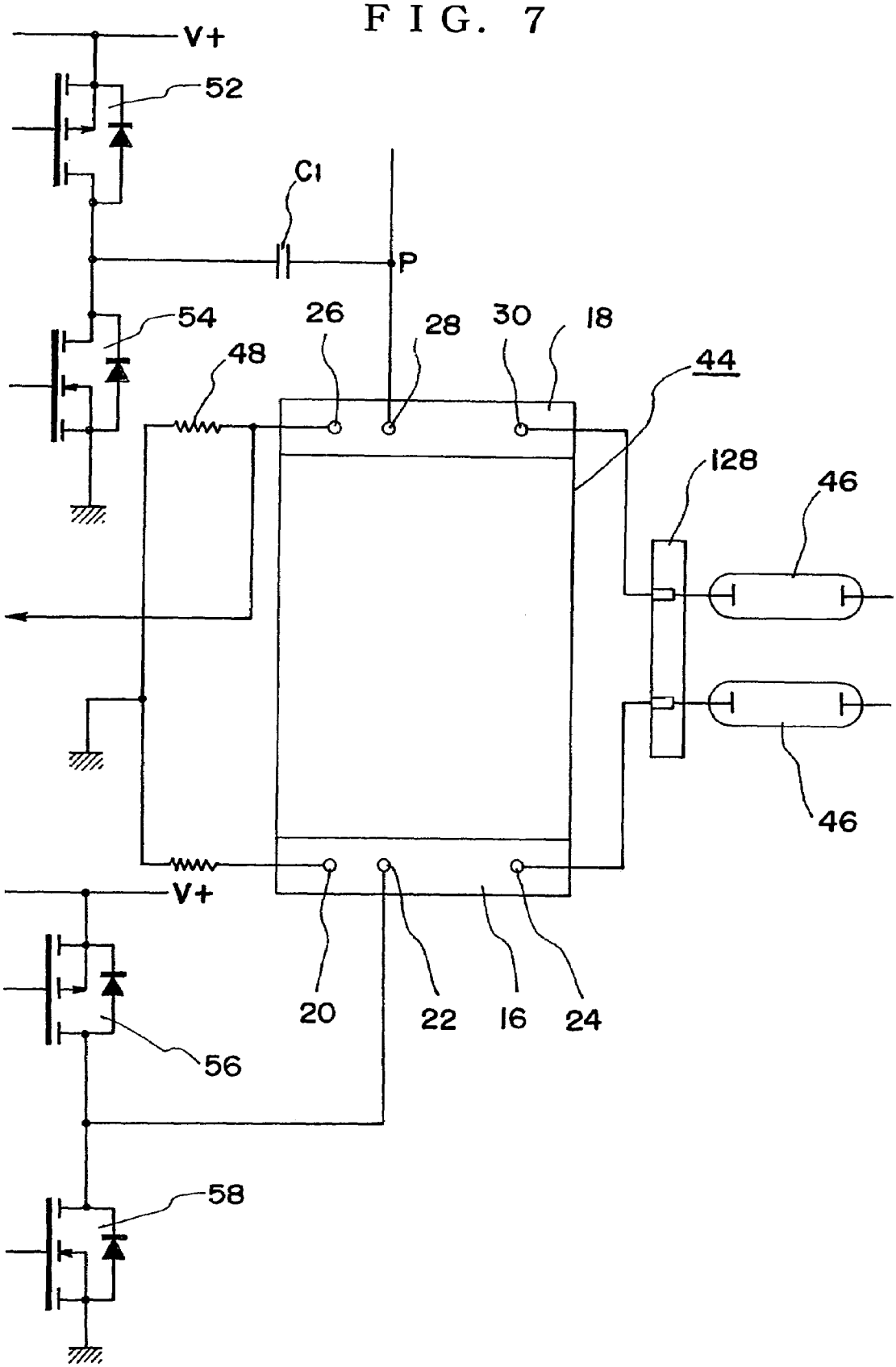
FIG. 7 is an explanatory drawing of the present invention.

The electric current flows alternately in direction of I1 and I2 by the on-off of the switching elements 52, 54, 56, 58, and the self commutating circuit performs self commutation with resonance frequency at the primary side of the wound rotor transformer 10. To the electrodes of both terminals of two pieces of fluorescent lamps 46, 46, the high tension of the winding at the secondary side of the transformer is impressed whereby no irregularity in brightness occurs. When the wound rotor transformer 44 is fixed to the substrate in a proper direction as shown in FIG. 7, secondary high tension terminals 24, 30 are disposed side by side sandwiching the bobbin (insulator) 2 at the right side terminal units 16, 18 extending in a right angle direction relative to an axial direction of the bobbin (insulator) 2, and at the left side, the ground terminals 20, 26 and the primary input terminals 22, 28 are disposed side by side by sandwiching the bobbin (insulator) 2. For this reason, the lamps 46, 46 are connected to the wound rotor transformer 44 by means of a connector 128 simply with a shortest possible distance, and the simple construction is arranged for the connecting wiring between the transformer 44 and the lamps 4, 46 and the connecting wiring with the self commutating circuit. Moreover, as will be obvious from FIG. 7, as the high tension terminal at the right side of the wound rotor transformer and the low tension terminal at the left side thereof, edge face distance between the high tension side and the low tension side of the transformer can be assured widely whereby a stable operation of the transformer and its miniaturization can be obtained.

For reference, either of the embodiments is such that the resonance frequency at the primary side of the wound rotor transformer is produced through the lead wire from the primary side of the wound rotor transformer, but the invention is not limited in particular to this construction, and another construction may be such that the primary side resonance frequency is detected by the frequency analyzing circuit from the resonance frequency at the secondary side of the wound rotor transformer, and the logic circuit 78 or the PWM control circuit 76 and the like can be operated by this detection signal.

The present embodiment, as described in the foregoing, is able to obtain the resonance voltage higher than the input power source voltage at the primary side of the wound rotor transformer so that number of windings at the secondary side of the wound rotor transformer can be reduced, and its design can be miniaturized. For this reason, the wound rotor transformer to be used in the present invention is the size almost identical with that of the wound rotor transformer of normal one input/one output type, and it is possible to prepare the one input/two output type wound rotor transformer.

Moreover, another embodiment of the wound rotor transformer is described in the following by referring to FIG. 8.

In the drawing, numeral 130 denotes a bobbin (insulator), and is inserted into one of parallel portion of the core 132. The core 132 is constructed in □ shape by joining two pieces of core of □ shape. At both ends of the bobbin (insulator) 130, terminal units 134, 136 are mounted and on each terminal unit 134, 136, secondary side high tension terminals 38, 40, secondary side ground terminals 142, 144, primary side input terminals 146, 148 are provided. At the center of the bobbin (insulator), a primary winding 150 is disposed, and both terminals of the primary winding 150 are connected to the primary input terminals 146, 148 as shown in the drawing through the lead wire. Secondary windings 156, 158 are disposed at both terminals of the primary input winding 150 by means of the partitions 152, 154 for insulation and pressure resistance in order to assure a distance between the windings. The winding start ends of the secondary windings 156, 158 are connected to the primary high tension terminals 138, 140 by means of the lead wire, and the winding end terminal is connected to the ground terminals 142, 144 as shown in the drawing by means of the lead wires respectively.

With the foregoing construction, a unit of one input with plural outputs can be obtained by a simple construction. Also, the other parallel portion of the core 132 can be similarly constructed, and in this case, the primary sides are connected in series or parallel to form one input and four outputs.

Figure 8:
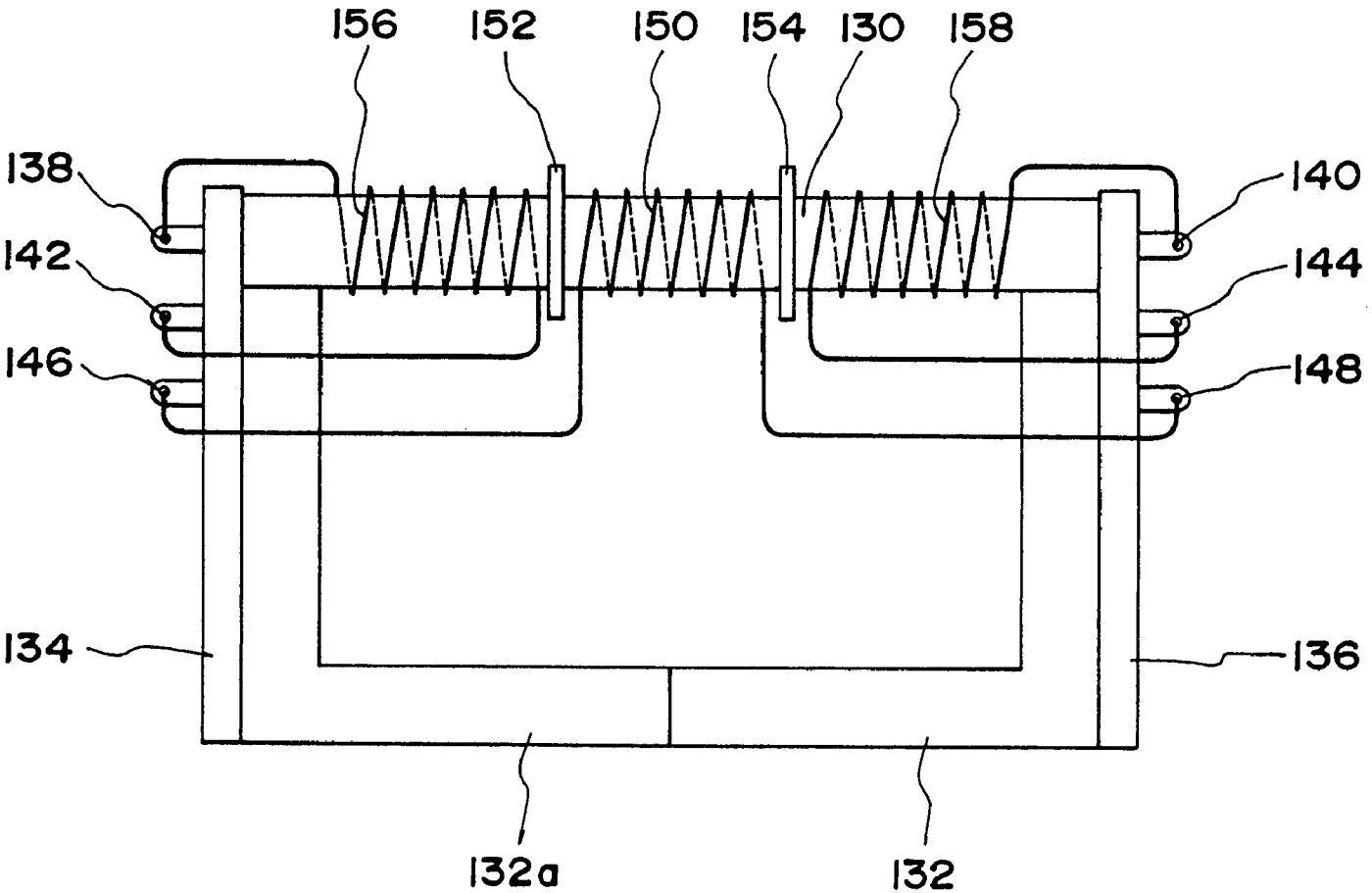
FIG. 8 is an explanatory drawing showing another embodiment of the wound rotor transformer.
Figure 9:
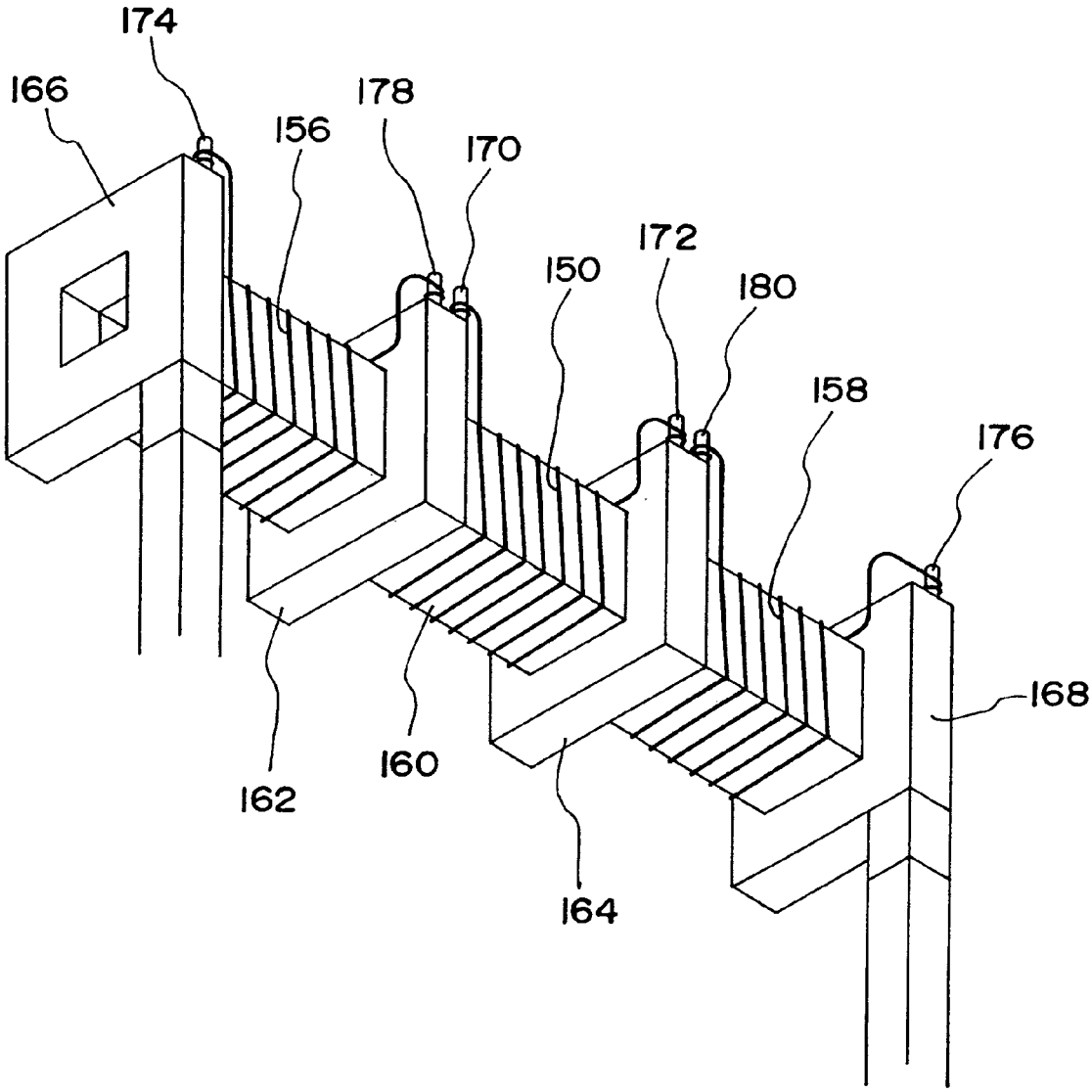
FIG. 9 is an explanatory drawing of an outside view showing in another embodiment of the wound rotor transformer.

Moreover, in the foregoing construction shown in FIG. 8, as shown in FIG. 9, terminal units 152, 164 serving double for partition are provided at a middle of the bobbin (insulator) 160, and terminal units 166, 168 are provided at both ends of the bobbin (insulator) 160 and both terminals of the primary winding 150 are connected to the primary input terminals 170, 172 by means of the lead wire, and each winding start end of the secondary windings 156, 158 is connected to the secondary side high tension terminals 174, 176 by means of the lead wire, and each winding end terminal of the secondary windings 156, 158 may be connected to ground terminals 178, 180 by means of the lead wire.

Figure 11:
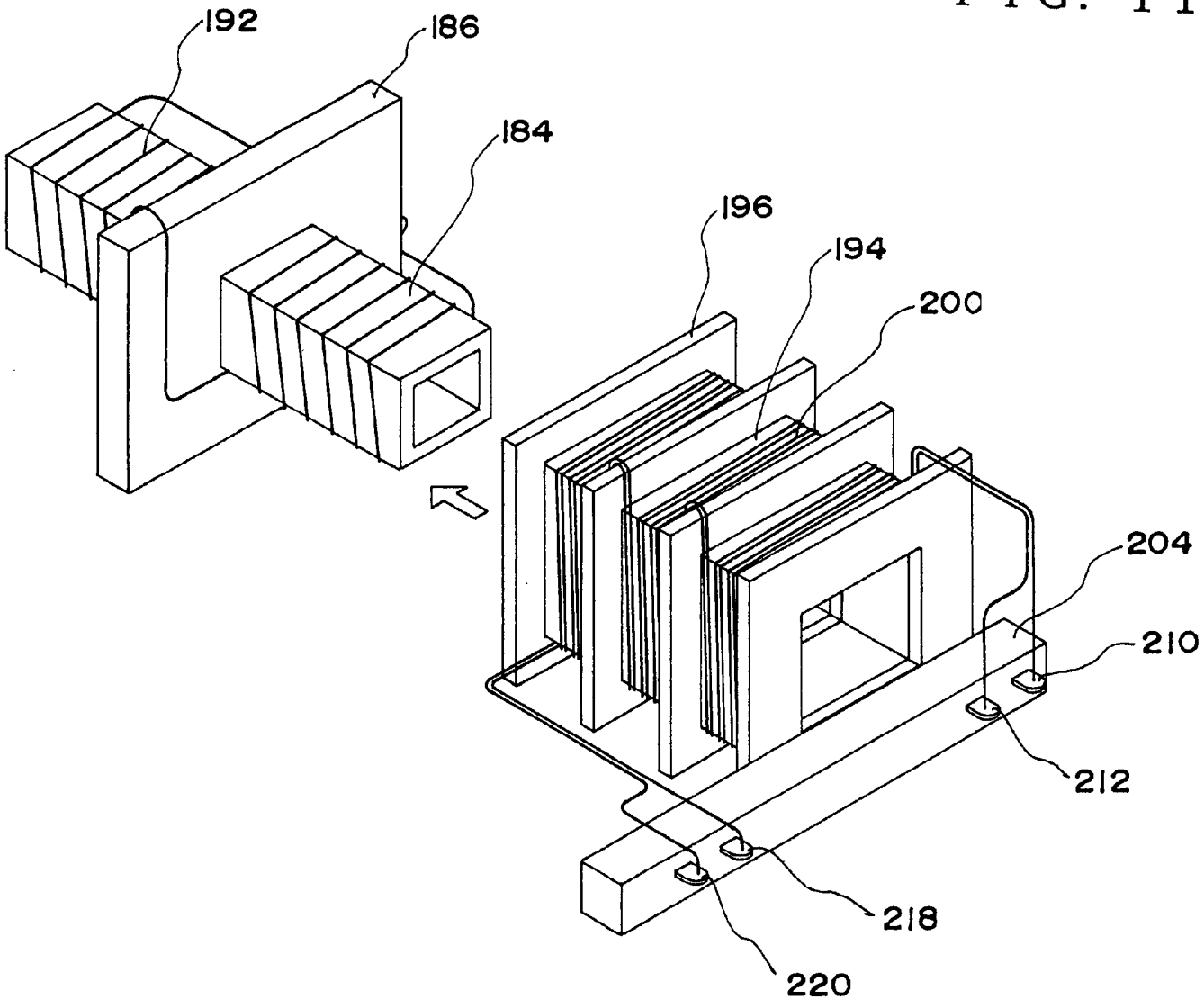
FIG. 11 is an explanatory drawing of an outside view showing another embodiment of the wound rotor transformer.

Another embodiment of the wound rotor transformer will be described in the following by referring to FIG. 1 and FIG. 11.

Figure 10:
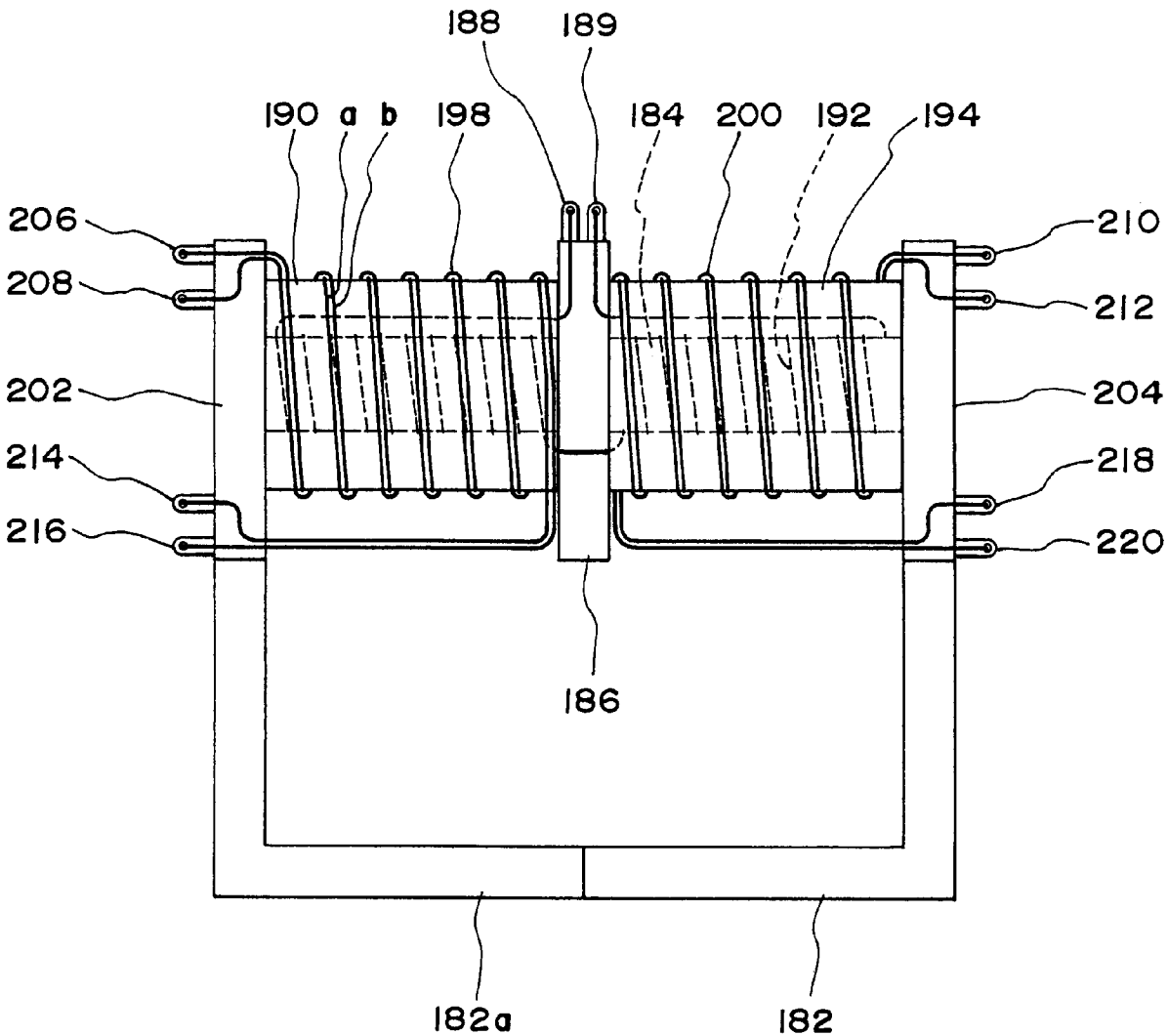
FIG. 10 is an explanatory drawing of an outside view showing another embodiment of the wound rotor transformer.

Numeral 182 denotes a core, and constitutes a # shape core by joining two pieces of # shape core. To one part of parallel portion of the core 182, a bobbin for primary (insulator) 184 is inserted and disposed. At the center of the primary bobbin (insulator) 184, a terminal unit 186 is mounted, and primary input terminals 188, 190 are provided on the terminal unit 186. On the bobbin (insulator) 184, a primary winding 192 is mounted, and at both terminals of the primary winding 192, primary input terminals 188, 190 are connected by means of the lead wire. At the outside of the primary bobbin (insulator) 184, a pair of secondary bobbins (insulator) 192, 194 are inserted and disposed which are positioned at both sides of the terminal unit 186. A partition 196 at each end of a pair of the secondary bobbins (insulator) 192, 194 abuts both side surfaces of the terminal unit 186. In FIG. 10, the partition 196 of the secondary bobbins (insulator) 192, 194 is not shown in the drawing for avoiding a complication of the drawings. Secondary windings 198, 200 are wound on the secondary bobbins (insulator) 192, 194 by two pieces of wires a, b that are duplex winding. The winding start ends of the secondary windings 198, 200 that are of the duplex wires are connected to a secondary high tension terminals 206, 208, 210, 212 provided on the respective terminal units 202, 204 of the secondary bobbins (insulator) 192, 194 by means of the lead wires, and the winding ends are connected to ground terminals 214, 216 by means of the lead wires.

In the foregoing construction, a relationship of the primary winding 192 and the secondary windings 198, 200 is such that in the double layer structure of the bobbin (insulator), the secondary windings 198 and 200 are disposed at both sides of the primary winding, whereby multiple outputs can be constructed by a simple structure. In this embodiment, the high tension might be applied to duplex parallel lines forming the secondary windings, but the high tension is of mutually identical electric potential so that there is no chance of causing a short circuit or leakage of electric current in the parallel secondary windings. Moreover, the other parallel portion 182*a* of the core 182 can be made in a similar construction and in case of making this vertically symmetrical structure, one input can be made by connecting the primary side in series or parallel to produce 8 outputs. When a number of windings is set to be 3 pieces or 4 pieces, multiple outputs can be materialized. For reference, the wound rotor transformers of the embodiment shown in FIG. 8 to FIG. 11 are operated by the self commutating circuit shown in FIG. 6.

Another embodiment of the wound rotor transformer in which secondary windings are disposed at both sides of the winding of the primary input will be described in the following.

Figure 12:
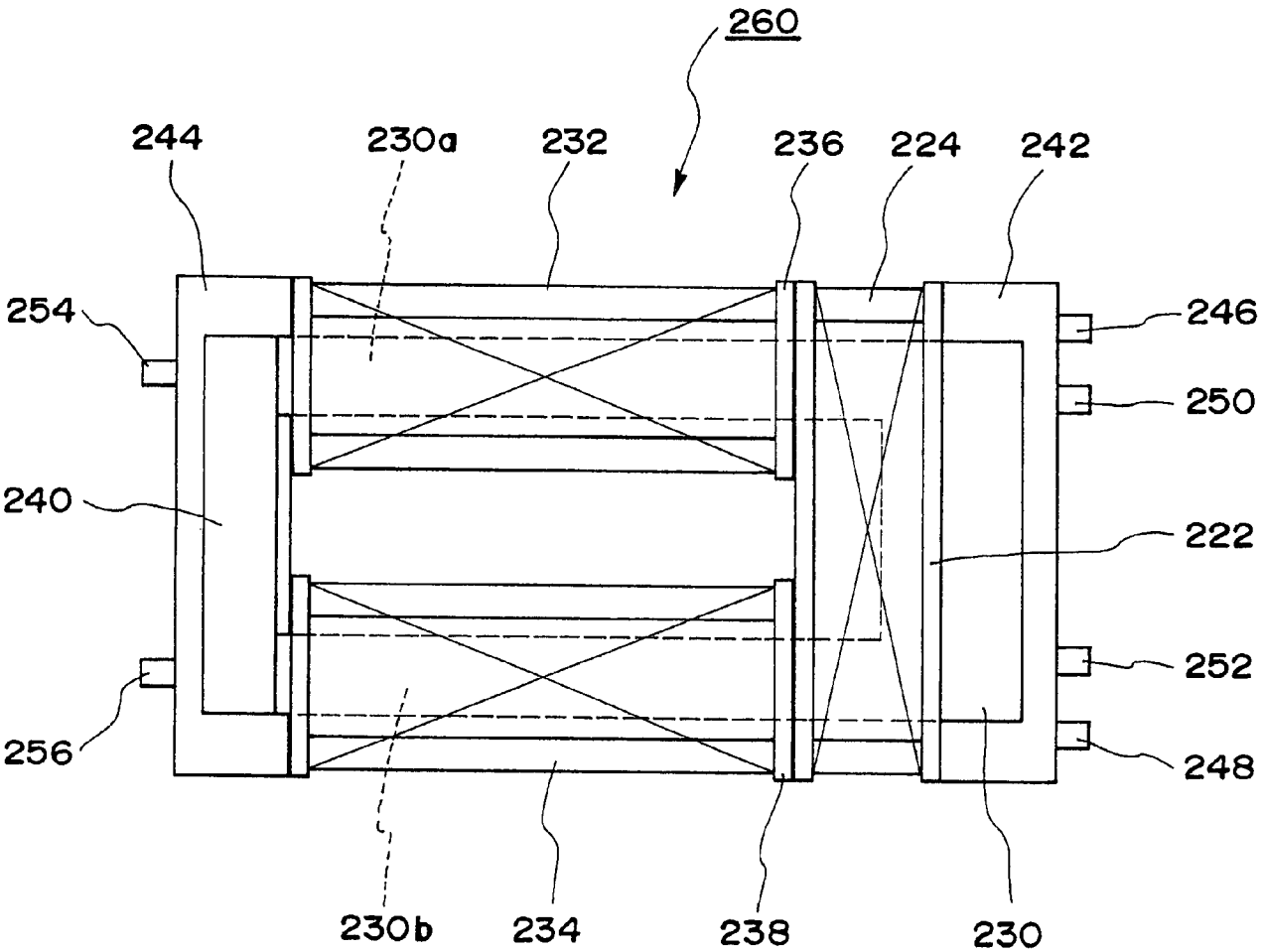
FIG. 12 is an explanatory drawing showing another embodiment of the wound rotor transformer.

In FIG. 12, numeral 222 denotes a bobbin (insulator), and a primary winding 224 is mounted on its external peripheral portion. Holes 226, 228 that penetrate in a thickness direction are formed on an inside diameter of the bobbin 22, and parallel portions 230*a*, 230*b* of the core 230 of U-shape are inserted in the holes 226, 228. The inside diameter portions of the bobbins 236, 238 mounted with the secondary windings 232, 234 are inserted into the parallel portions 230*a*, 230*b*. Numeral 240 denotes a bar like core coupled to an open end of the U-shape core, which is designed to make a magnetic circuit formed by the core to be a closed loop. Terminal units 242, 244 are mounted on both sides of the core 230, and on one terminal unit 242, secondary ground terminals 246, 248 and primary input terminals 250, 252 are provided, and on the other terminal unit 244, secondary high tension terminals 254, 256 are provided. Both ends of the primary winding 224 are connected to the corresponding primary input terminals 250, 252, and the high tension sides of the secondary windings 232, 234 are connected to the corresponding secondary high tension terminals 254, 256, and each ground side is connected to the corresponding secondary ground terminals 246, 248.

Figure 13:
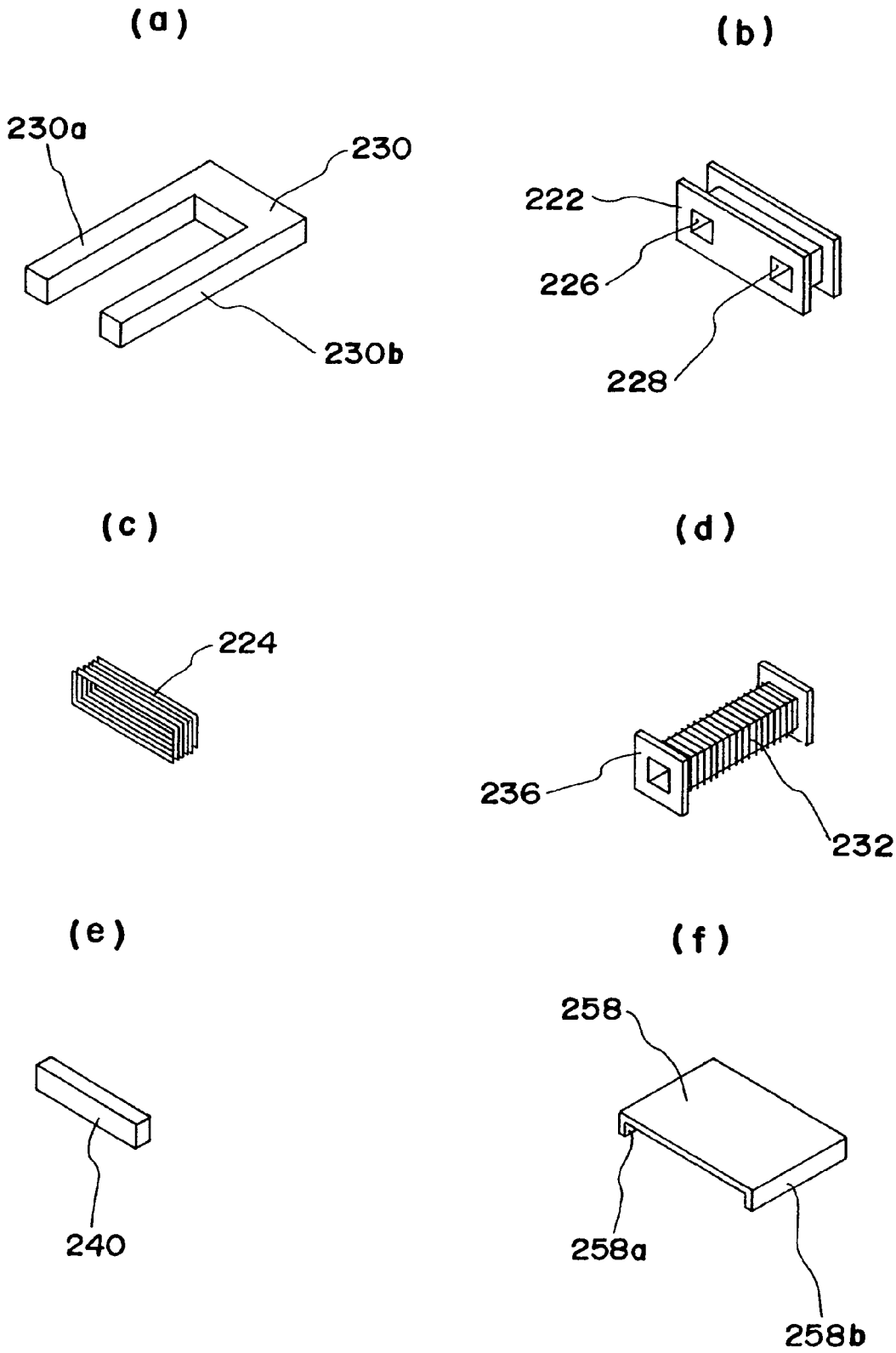
FIG. 13 is an explanatory drawing of an outside view showing another embodiment of the wound rotor transformer.

The foregoing primary winding 224 is constructed as shown in FIG. 12 that its inside diameter portion is spanned over a part of the parallel portions 230*a*, 230*b* of the core 230 and a part of a vertical portion of the core 230. For reference, as a method of transforming the magnetic circuit of the core 230 to a closed loop, an arrangement can be made to cover the core 230 with the core 258 by using the core 258 shown in FIG. 13 (f), and to abut the end edge portion 258*a* of one part against the open ends of the parallel portions 230*a*, 230*b* of the core 230, and to abut the other end edge portion 258*b* against the vertical portion of the core 230.

By preparing the foregoing construction, it becomes possible to construct a small size one input/two outputs type wound rotor transformer by arranging the primary winding in the middle and the secondary windings at its both sides.

The foregoing transformer 260 is provided for service by being connected to the self commutating circuit of primary series resonance type similar to the transformer shown in FIG. 6. Moreover, a multi-output type wound rotor transformer can be provided by making the secondary windings 232, 234 of the transformer 260 to become a multi-output type wound core transformer.

Figure 14:
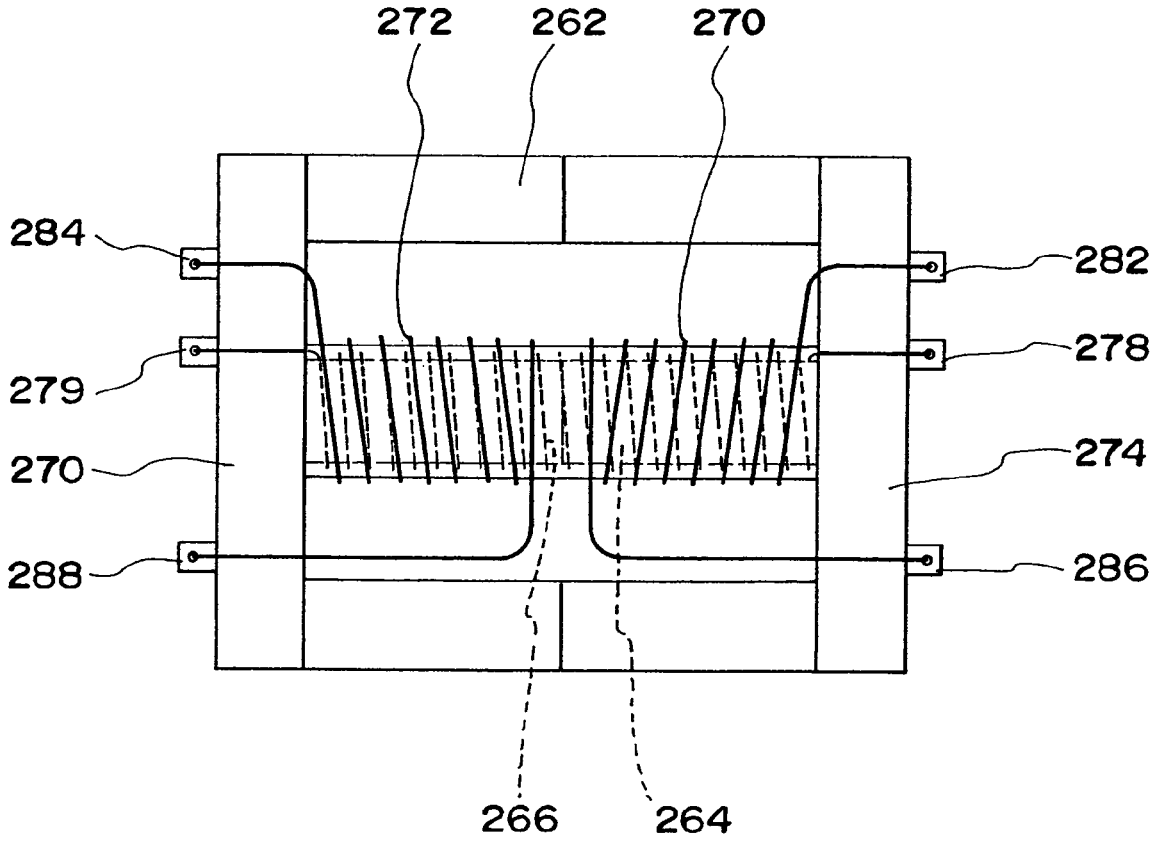
FIG. 14 is a explanatory drawing showing another embodiment of the wound rotor transformer.

An embodiment that has materialized a double layer structure of the primary winding and the secondary winding with use of an insulation film will be described in the following by referring to FIG. 14.

Numeral 262 denotes a core formed by joining a pair of E-shaped cores symmetrically, and a bobbin 264 is mounted on an inside portion of the core, and a primary winding 266 is wound on the bobbin 264. An insulation film 268 covers the primary winding 266. Secondary windings 270, 272 are wound on the insulation film 268 which are positioned at both right and left sides of the primary winding 266. 400 to 1000 turns of each secondary winding 270 and 270 are applied and the insulation film (drawing is omitted) is disposed on portions where windings are mutually duplicated. Between the secondary windings 270 and 272, and over the secondary windings 270 and 272, the partition (drawing is omitted) for insulation and pressure resistance is properly provided on the secondary windings 270 and 272. Both terminals of the primary winding are connected to the primary input terminals 278, 280 of the terminal units 274, 276 provided at both sides of the core 262. One of the secondary windings 270, 272 is respectively connected to secondary ground terminals 282, 284, and the other of the secondary windings 270 and 272 are connected to the secondary high tension terminals 286, 288.

A wound core transformer with secondary windings structure can be provided by forming the foregoing construction to obtain one input/two output type transformer suitable for a small size transformer wherein the primary winding is disposed in its center and the secondary windings are disposed at its both sides.

The foregoing transformer can be used by being connected to a self commutating circuit of primary series resonance type similar to the transformer shown in FIG. 6. Moreover, the secondary windings 270, 272 of the transformer are arranged to be a parallel winding as shown in FIG. 11 whereby a multi-output type wound rotor transformer can be produced.

Figure 15:
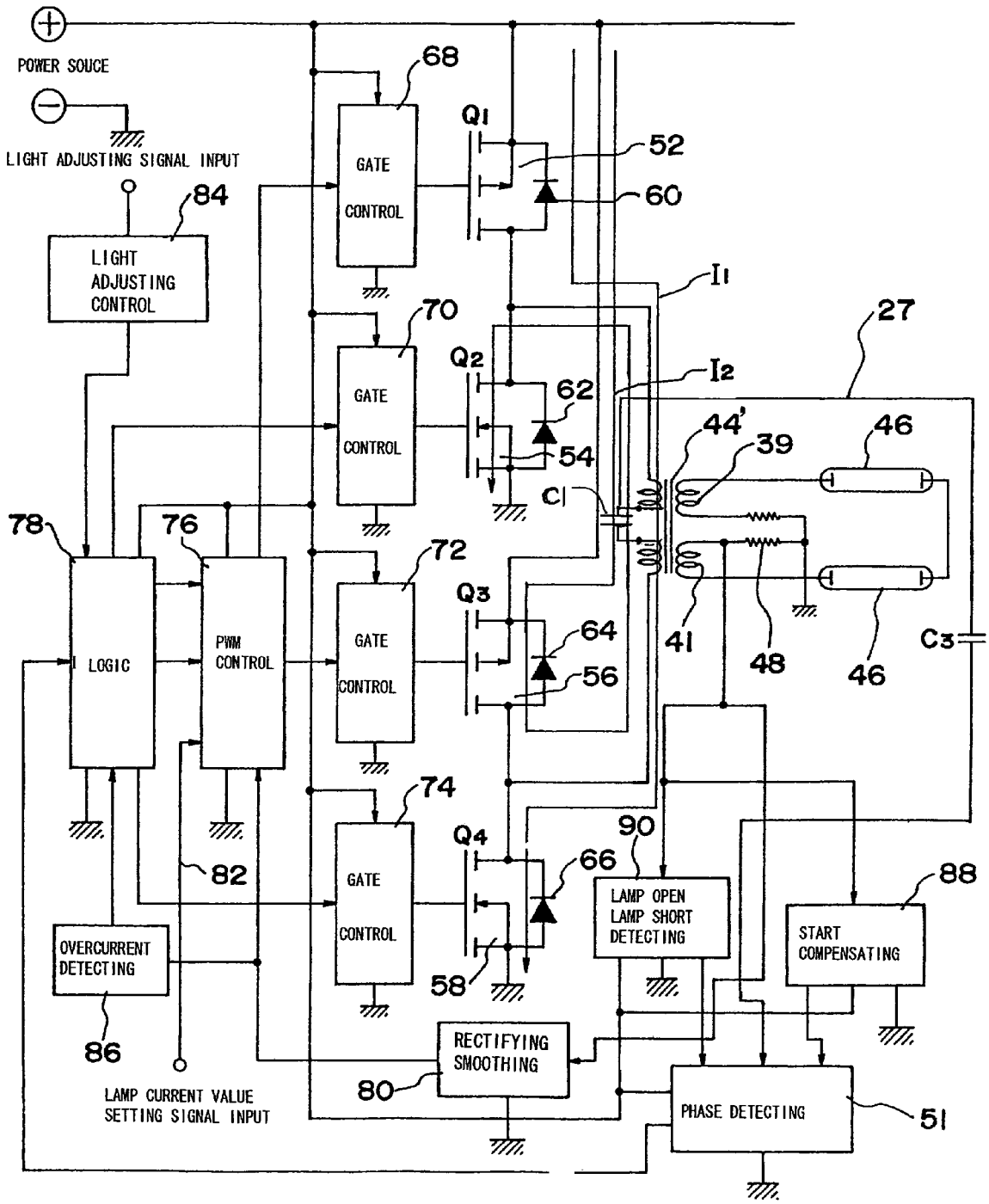
FIG. 15 is a block circuit diagram showing another embodiment of the present invention.
Figure 16:
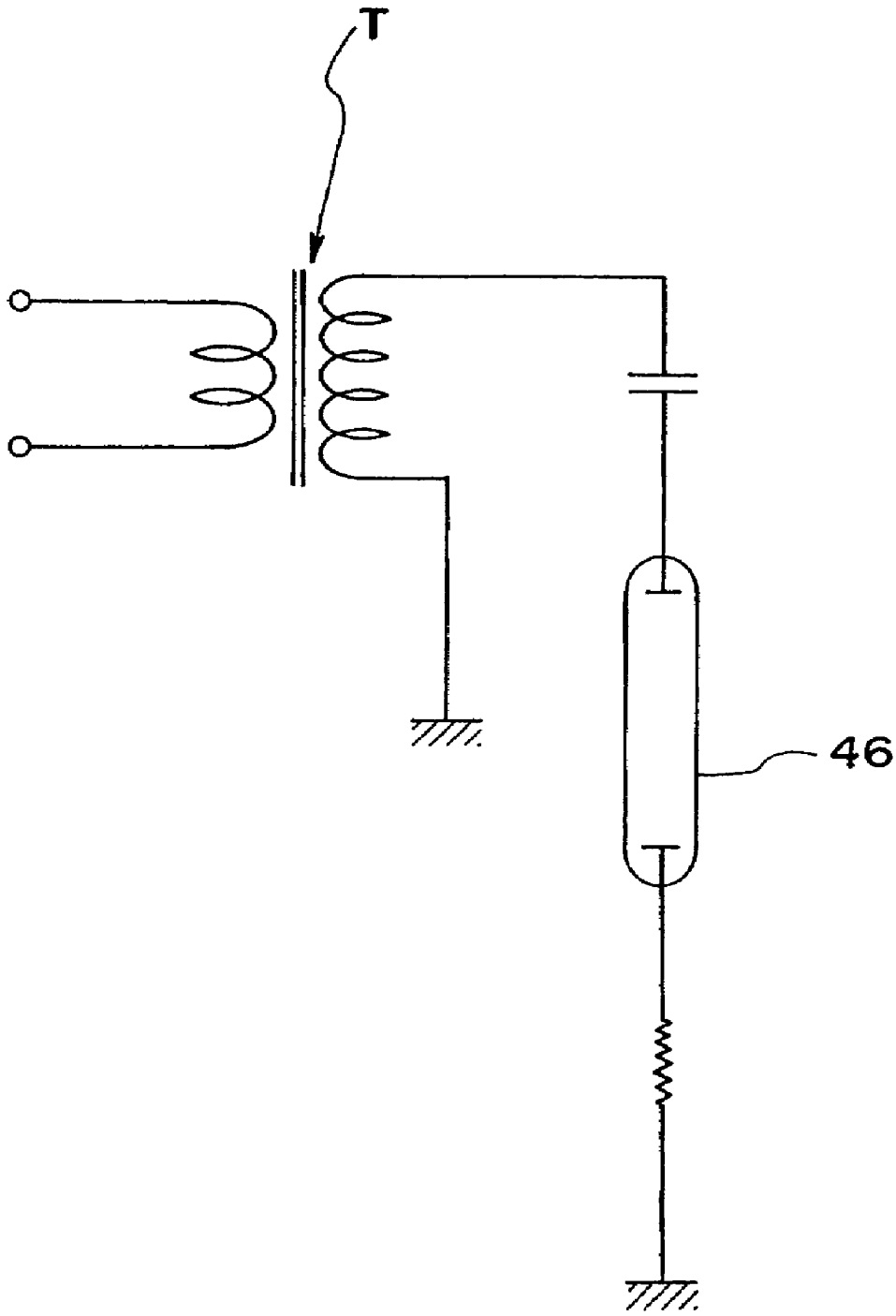
FIG. 16 is a circuit diagram of the conventional technology.
Figure 17:
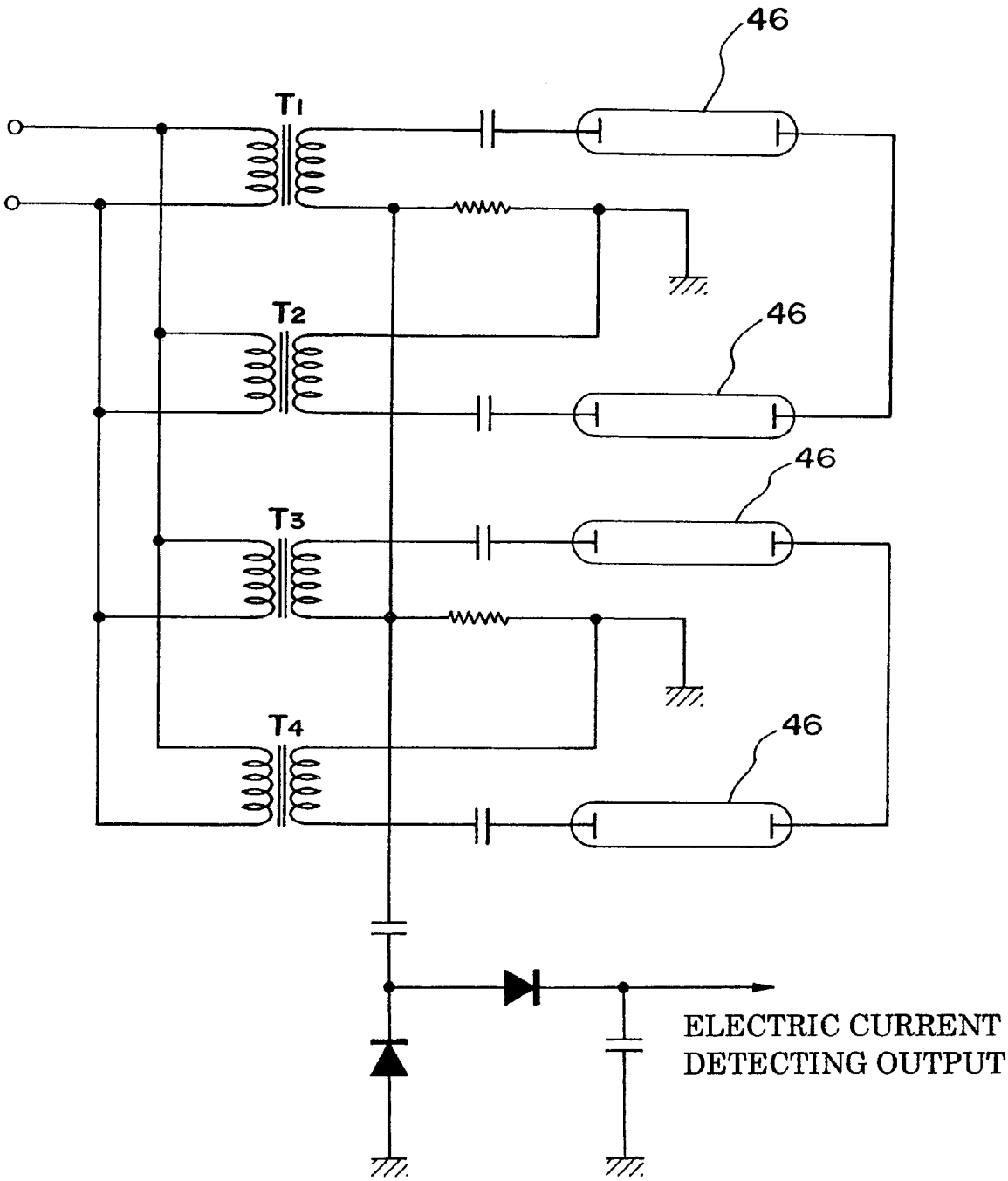
FIG. 17 is a circuit diagram of the conventional technology.

In the embodiment as shown in FIG. 6, a resonance capacitor C1 is serially connected to a terminal of the primary winding of the output transformer 44, and a series commutating circuit is formed at the primary side of the output transformer 44, but this invention is not particularly limited to this construction. For example, as shown in FIG. 15, in the output transformer shown in each of the foregoing embodiments wherein the primary winding is disposed in the center and the secondary windings are disposed at its both sides, the primary winding is wound, for example, 11 turns each to form taps, and the resonance capacitor C1 is connected in series as shown in FIG. 15 to form an output transformer 44'. The construction of the primary side series commutating circuit LC can be made in symmetry with the capacitor C1 being the center, and by this symmetrical construction, the output transformer 44' can be efficiently driven. The lead wire 27 for detection of the voltage phase signal at the primary side is connected to a connecting point of the capacitor C1 and the mid point tap of the primary side winding as shown in the drawing. Moreover, the capacitor C1 can be formed by mutually connecting two pieces of capacitors, and the lead wire 27 may be connected to the connecting point of the capacitors. When the foregoing construction is formed, symmetry at the primary side of the output transformer can be made as a perfect one. As to the core of the output transformer used in the foregoing embodiment, a ferrite core having insulating properties can be used. In case of using the insulating core, the winding can be directly mounted on the core without using the bobbin or the insulating film.

What is claimed is:

1. A power source device comprising a primary winding wound on a core by means of an insulator, a first secondary winding adjacent to the primary winding and being disposed at its one side, a second secondary winding adjacent to the primary winding and being disposed at the other side, a primary input terminal for the primary winding, a secondary high tension terminal for the first secondary winding, a secondary high tension terminal for the second secondary winding, and a ground terminal for the second secondary winding; wherein the primary winding is connected to the primary input terminal and the lead wire of one end of the first secondary winding is connected to the secondary high tension terminal for the first secondary winding, and the lead wire of the other end of the first secondary winding is connected to the ground terminal for the first secondary winding, and the lead wire of one end of the second secondary winding is connected to the ground terminal for the second secondary winding, and a core is disposed inside of said each winding, and the secondary windings disposed at both sides of the primary winding constitute a plurality of outputs, and the commutating capacitor is connected to the primary winding of a wound rotor transformer to provide a primary side resonance circuit, and a self commutating circuit that self commutates with the primary side resonance frequency on the basis of the feedback signal of the primary side resonance voltage of the wound-rotor transformer is connected to the primary winding.

2. A power source device according to claim 1, wherein two pieces of first and second fluorescent lamps are connected in series, and among the first and second fluorescent lamps, one electrode of the first fluorescent lamp is connected to a secondary high tension terminal of the first secondary winding, and the second fluorescent lamp is connected to the secondary high tension terminal of the second secondary winding.

3. A power source device wherein a primary winding is mounted on a central portion of a bobbin, and first and second secondary windings are mounted at both sides of the primary winding, and a partition for insulation and pressure resistance is disposed in a border of the primary winding and the first and second secondary windings at its both sides, and a first terminal unit is provided at one end of the bobbin, and a second terminal unit extending to the other end of the bobbin is provided, and a secondary high tension terminal is provided at one side of respective terminal units, and a primary input terminal and a ground terminal are provided at a position with a distance from the secondary high tension terminal at the other side of the respective terminal units, and the lead wire of one end of the primary winding and the lead wire of the end portion of the winding at the side in contact with the primary winding of the first secondary winding are led to one end of the bobbin, and the lead wires are connected to the corresponding primary input terminal and the ground terminal, and the lead wire of one end of the second terminal unit side of the second secondary winding is connected to the secondary high tension terminal of the second terminal unit, and the lead wire of the other end of the primary winding and the lead wire of the end portion of the side in contact with the primary winding of the second secondary winding are led to the other end of the bobbin, and the wire is connected respectively to the corresponding primary input terminal and the ground terminal of the second terminal unit, and the core is mounted on the bobbin, and one input/two outputs are formed with the primary winding and the secondary windings at its both sides, and a resonance capacitor is connected to the primary winding of a wound rotor transformer to provide a primary side resonance circuit, and a self commutating circuit that self commutates with the primary side resonance frequency is connected to the primary winding on the basis of the feedback signal of the primary side resonance voltage.

4. The power source device according to claim 3, wherein two pieces of first and second fluorescent lamps are connected in series, and among the first and second lamps, an electrode of the first fluorescent lamp is connected to the first secondary high tension terminal, and the second fluorescent lamp is connected to the secondary high tension terminal of the second fluorescent lamp.

* * * * *